US007073339B2

(12) United States Patent
Hall et al.

(10) Patent No.: US 7,073,339 B2
(45) Date of Patent: Jul. 11, 2006

(54) PRESSURE CONTROL DEVICE FOR CRYOGENIC LIQUID VESSEL

(75) Inventors: Ivan Keith Hall, Mobile, AL (US); Justin Charles Gish, Mobile, AL (US)

(73) Assignee: Harsco Technologies Corporation, Fairmont, MN (US)

( * ) Notice: Subject to any disclaimer, the term of this patent is extended or adjusted under 35 U.S.C. 154(b) by 229 days.

(21) Appl. No.: 10/754,756

(22) Filed: Jan. 9, 2004

(65) Prior Publication Data

US 2005/0150236 A1 Jul. 14, 2005

(51) Int. Cl.
*F17C 7/04* (2006.01)

(52) U.S. Cl. ..... 62/48.1; 62/50.2

(58) Field of Classification Search ..... 62/48.1, 62/48.2, 50.1, 50.7; 261/124; 137/888; 417/151

See application file for complete search history.

(56) References Cited

U.S. PATENT DOCUMENTS

| | | | | |
|---|---|---|---|---|
| 3,733,838 | A * | 5/1973 | Delahunty | 62/48.2 |
| 5,228,295 | A * | 7/1993 | Gustafson | 62/50.1 |
| 5,404,918 | A | 4/1995 | Gustafson | |
| 5,421,161 | A | 6/1995 | Gustafson | |
| 5,590,535 | A * | 1/1997 | Rhoades | 62/50.2 |
| 6,076,360 | A * | 6/2000 | Viegas et al. | 62/50.2 |
| 6,128,908 | A | 10/2000 | Gustafson | |
| 6,745,576 | B1 * | 6/2004 | Granger | 62/48.2 |
| 6,852,145 | B1 * | 2/2005 | Muller | 261/76 |
| 6,904,758 | B1 * | 6/2005 | Hall et al. | 62/45.1 |
| 2005/0028536 | A1 * | 2/2005 | Noble et al. | 62/45.1 |

FOREIGN PATENT DOCUMENTS

| | | | |
|---|---|---|---|
| JP | 56167993 | A * | 12/1981 |
| JP | 61010200 | A * | 1/1986 |
| JP | 08173781 | A * | 7/1996 |

* cited by examiner

*Primary Examiner*—William Doerrler
*Assistant Examiner*—Michael J. Early
(74) *Attorney, Agent, or Firm*—David C. Jenkins; Eckert Seamans Cherin & Mellott, LLC

(57) ABSTRACT

An economizer circuit assembly for a cryogenic liquid vessel assembly is disclosed. The cryogenic liquid vessel assembly includes a first, outer shell and a second, inner shell defining a storage space. The storage space has a liquid space and a vapor space. The cryogenic vessel also has a delivery line extending from outside the first, outer vessel shell into the liquid space. The economizer circuit assembly includes a vent line and an integration device. The vent line extends from outside the first, outer shell into the cryogenic vessel. The vent line has a first end and a second end. The first end is disposed in the vapor space. The vent line and the delivery line are coupled, and in fluid communication at, the integration device.

20 Claims, 2 Drawing Sheets

PRESSURE CONTROL DEVICE FOR CRYOGENIC LIQUID VESSEL

BACKGROUND OF THE INVENTION

1. Field of the Invention

This invention relates to a pressure control device for a cryogenic liquid vessel and, more specifically, a pressure control device for a cryogenic liquid vessel wherein the economizer circuit utilizes a flow integration device to combine the gas from the vessel vapor space with liquid from the vessel liquid space.

2. Background Information

Cryogenic liquids, such as liquid natural gas (LNG), nitrogen, oxygen, $CO_2$, hydrogen and the like, are substances that normally exist as gasses, but are liquids at cold temperatures. Special vessels and systems must be used to store and transfer cryogenic liquids because of difficulty in maintaining the extremely cold temperatures. Such vessels typically include a double walled vessel having a vacuum in the annular space. While the vacuum provides an effective insulation, the insulation is not perfect and, as such heat penetrates the vessel. When heat is added to the cryogenic liquid, a portion of the liquid returns to the gaseous state. The gas within the vessel increases the internal pressure. Eventually, to prevent over pressurization of the vessel, the gas must be vented. It is desirable to prevent, or at least delay, the venting of the gas.

Unless a cryogenic liquid vessel is merely a storage vessel, the cryogenic liquid vessel is typically coupled to a use device. For example, where the cryogenic liquid is LNG, the use device is typically an engine. The following description shall use the example of LNG and an engine, but it is understood that the system described herein is applicable to any cryogenic liquid and any use device. The fuel system for the engine includes the cryogenic vessel, a delivery line extending from the cryogenic vessel to the engine, a vaporizer on the delivery line and an economizer circuit. Within the cryogenic liquid vessel are a liquid space and a vapor space. The delivery line is in fluid communication with the cryogenic vessel liquid space and the economizer circuit is in fluid communication with both the cryogenic vessel vapor space and the delivery line. Because the engine uses the natural gas in a gaseous state, a vaporizer may be located on the delivery line extending from the cryogenic liquid vessel to the engine.

In operation, if the vessel does not have a sufficient pressure, a small quantity of cryogenic liquid may be removed from the liquid space, passed through a vaporizer where it converted to gas, and returned to the vapor space of the cryogenic liquid vessel. Alternatively, when the engine is not running, any excess cryogenic liquid from within the delivery line is allowed to evaporate and is returned to the vapor space through the economizer circuit. This gas pressurizes the cryogenic liquid vessel so that, when the engine is running, the pressure within the vessel causes the cryogenic liquid to exit the vessel to be delivered to the engine. Once the vessel is pressurized the delivery line may be opened to deliver LNG to the vaporizer or engine. Within the vessel, the vapor and the cryogenic liquid are at the same pressure. However, due to the additional pressure created by the weight of the cryogenic liquid, there is a slightly higher pressure acting on the delivery line. Thus, the path of least resistance to fluid flow is through the liquid portion of the delivery line and, when both the economizer circuit and the delivery line are open, fluid will flow from the liquid space within the vessel.

As noted above, heat causes the cryogenic liquid within the cryogenic liquid vessel to be converted to gas and may cause an undesired increase in pressure. To prevent the venting of gas to the atmosphere when the cryogenic vessel is over-pressurized, gas is removed from the vapor space within the cryogenic vessel and delivered to the engine. While a direct connection between the cryogenic vessel vapor space and the engine is possible, more typically, the gas is withdrawn through the economizer circuit. That is, the economizer circuit is in fluid communication with the delivery line. Thus, to deliver gas from the cryogenic liquid vessel vapor space, the flow of the cryogenic liquid through the delivery line is suspended to allow gas from the vapor space to travel through the economizer circuit into the delivery line and then to the engine. Typically, flow of the cryogenic liquid within the delivery line is stopped by a valve structured to sense the pressure within the cryogenic liquid vessel. When the pressure exceeds a set limit, the valve closes and flow of the cryogenic liquid is stopped. Pressure within the cryogenic vessel causes the gas within the vapor space to be expelled through the economizer circuit and delivered to the engine, thereby reducing the pressure within the cryogenic vessel. Thus, with this system the flow of the cryogenic liquid is stopped when vapor is withdrawn.

There is, therefore, a need for a cryogenic liquid vessel that does not stop the flow of the cryogenic liquid while removing gas from the cryogenic liquid vessel vapor space.

There is a further need for a cryogenic liquid vessel that combines the flow of the cryogenic liquid and the gas while removing gas from the cryogenic liquid vessel vapor space.

There is a further need for a cryogenic liquid vessel that includes a flow integration device to combine the flow of the cryogenic liquid and the gas while removing gas from the cryogenic liquid vessel vapor space.

SUMMARY OF THE INVENTION

These needs, and others, are met by the present invention which provides for a cryogenic liquid vessel that includes a flow integration device to combine the flow of the cryogenic liquid and the gas while removing gas from the cryogenic liquid vessel vapor space. The flow integration device is disposed at the confluence of the delivery line and the economizer circuit. In one embodiment, the flow integration device includes a perforated vent line on the economizer circuit which extends vertically within the delivery line. In another embodiment, the flow integration device is a venturi assembly having a conduit with a restricted diameter and a venturi opening in fluid communication with the conduit. In this configuration, the vapor from the economizer circuit is integrated with the liquid flow. If the liquid is at a lower saturation pressure, the vapor will condense into liquid. If the vapor and the liquid are at, or about, the same saturation pressure, the vapor will be carried along by the liquid flow.

In the first embodiment, a portion of the delivery line extends vertically. The economizer circuit includes a vent line having a first end and a second end. The vent line first end is in fluid communication with the vapor space within the cryogenic liquid vessel. The economizer circuit vent line is joined to the delivery line at the vertical portion. The vent line second end extends within the delivery line in a vertical direction. The second end further includes a plurality of openings or perforations. In operation, the perforations integrate the gas from the economizer circuit into the flow of cryogenic liquid. As such, gas is constantly pulled from the vapor space so that an over-pressurized condition will not occur. The vent line may include a back-pressure regulator to close the vent line if the cryogenic vessel becomes under-pressurized.

In the second embodiment, the venturi assembly narrow conduit increases the speed of the flow of the cryogenic liquid. This increase in the flow speed creates a low pressure zone. The venturi opening is located within the low pressure zone. The economizer circuit vent line is coupled to the venturi opening and, as such, the low pressure zone draws gas from the vent line into the flow of the cryogenic liquid. As such, gas is constantly pulled from the vapor space so that an over-pressurized condition will not occur. The vent line may include a back-pressure regulator to close the vent line if the cryogenic vessel becomes under-pressurized.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
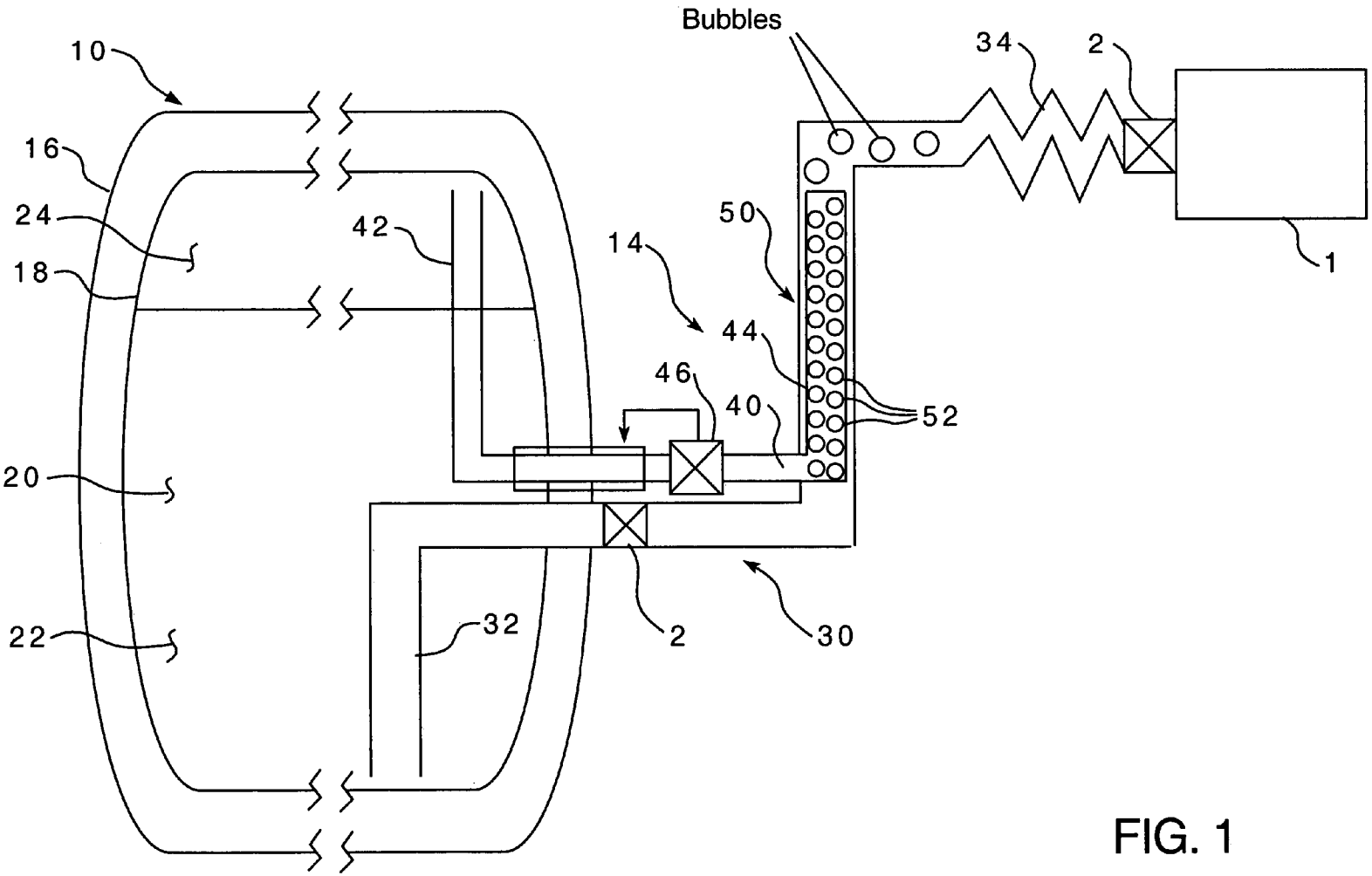
FIG. 1 is a schematic side view of the flow integration device.

As shown in FIG. 1, a cryogenic liquid vessel assembly 10 includes a cryogenic vessel 12 and an economizer circuit assembly 14. The cryogenic liquid vessel 12 includes a first, outer vessel shell 16 and a second, inner vessel shell 18. The inner vessel shell 18 defines a storage space 20 for the cryogenic liquid. Within the storage space 20 is a liquid space 22 and a vapor space 24. Between the first, outer vessel shell 16 and the second, inner vessel shell 18 is, preferably, a vacuum that acts as an insulating layer. As is known in the prior art, the cryogenic liquid vessel assembly 10 may include a plurality of lines (not shown) extending from outside the cryogenic liquid vessel assembly 10 into the storage space 20. Such lines may include, for example, a fill line, a manual vent line, and a pressure building circuit. The lines may further include safety devices such as relief valves and burst disks (not shown). The two lines shown are the delivery line assembly 30 and the economizer circuit assembly 14. The delivery line assembly 30 and the economizer circuit assembly 14 are coupled, and in fluid communication, at the integration device 50 (described below).

The delivery line assembly 30 includes a delivery line 32 that extends from a use device 1, such as, but not limited to, an engine, to a point within the liquid space 22, preferably near the bottom of the storage space 20. The delivery line assembly 30 may further include a vaporizer 34. The delivery line assembly 30 is structured to draw the cryogenic liquid from the liquid space 22 and deliver the cryogenic liquid, or a gas evaporated therefrom, to the use device 1. That is, while cryogenic liquid is withdrawn from the liquid space, the cryogenic liquid may be converted to gas within the delivery line 32. Alternatively, the cryogenic liquid may be delivered to the vaporizer 34. The vaporizer 34 converts the cryogenic liquid to a gas which is then delivered to the use device 1. The delivery line 32 includes a vertical portion 36 that extends in a generally vertical direction. The delivery line assembly 30 includes one or more valves 2, structured to open and close the delivery line 32.

The economizer circuit assembly 14 includes a vent line 40 and an integration device 50. The integration device 50 is, preferably disposed at a location outside of the first, outer vessel shell 16. The vent line 40 has a first end 42 and a second end 44. The vent line first end 42 extends into the cryogenic vessel vapor space 24. The vent line second end 44 extends into the delivery line vertical portion 36. The vent line second end 44, preferably, extends upwardly within the delivery line vertical portion 36. The integration device 50 includes the vent line second end 44 with the vertical orientation as well as a plurality of perforations 52. The vent line second end 42 may have, for example, an outer diameter of about 0.25 inch and the plurality of perforations 52 may have a diameter of between about 0.0625 inch and 0.125 in., and are more preferably about 0.125 in. The economizer circuit assembly 14 further includes a back pressure regulator 46. The back pressure regulator 46 is structured to close the vent line 40 when the pressure on the cryogenic liquid vessel assembly 10 side drops below a set limit. As is known in the art, both the delivery line assembly 30 and the economizer circuit assembly 14 may include valves structured to open and close the individual lines, as well as additional safety devices, such as relief valves and/or burst disks.

In operation, the vapor space 24 holds a quantity of gas that has evaporated from the cryogenic liquid. The gas pressurizes the storage space 20. When the delivery line assembly valve 2 is opened, cryogenic liquid flows through the delivery line 32 to the use device 1. Additionally, gas from the vapor space 24 flows through the economizer circuit assembly 14 to the integration device 50. As the cryogenic liquid passes over the integration device 50, lower density vapor bubbles form in the liquid flow within the integration device 50, rise, and are carried away. Thus, gas within the vapor space 24 is pulled from the cryogenic vessel storage space 20, thereby reducing the pressure within the cryogenic vessel storage space 20. If the pressure within the cryogenic vessel storage space 20 drops below a set limit, the back pressure regulator 46 closes the vent line 40, thereby allowing the pressure to build within the cryogenic vessel storage space 20.

Figure 2:
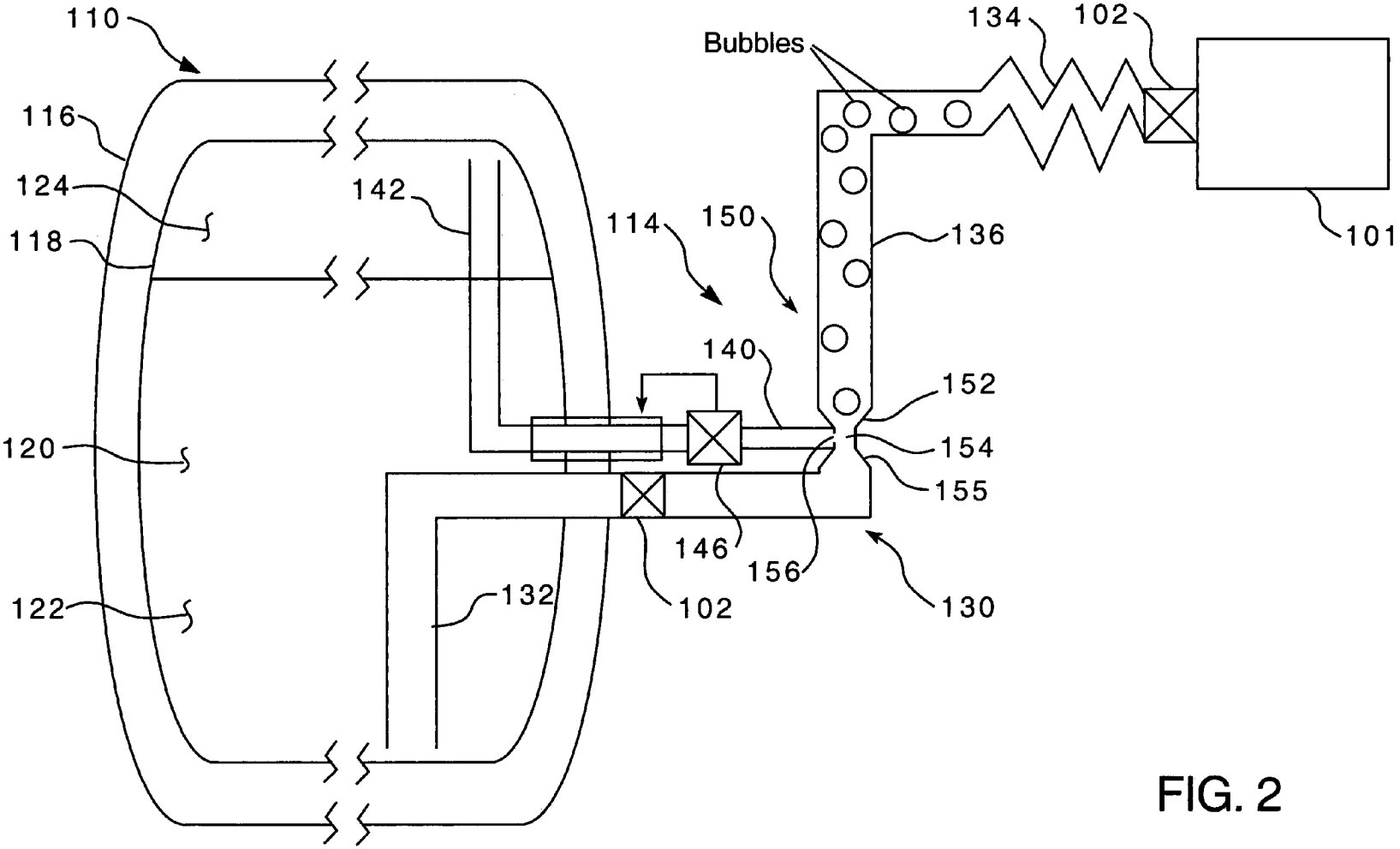
FIG. 2 is a schematic side view of a second flow integration device.

An alternate embodiment is shown in FIG. 2. The reference numbers in FIG. 2 represent like elements in FIG. 1, but are preceded by "100". Thus, as shown in FIG. 2, a cryogenic liquid vessel assembly 110 includes a cryogenic vessel 112 and an economizer circuit assembly 114. The cryogenic liquid vessel assembly 110 includes a first, outer vessel shell 116 and a second, inner vessel shell 118. The inner vessel shell 118 defines a storage space 120 for the cryogenic liquid. Within the storage space 120 is a liquid space 122 and a vapor space 124. Between the first, outer vessel shell 116 and the second, inner vessel shell 118 is, preferably, a vacuum that acts as an insulating layer. As is known in the prior art, the cryogenic liquid vessel assembly 110 may include a plurality of lines (not shown) extending from outside the cryogenic liquid vessel assembly 110 into the storage space 120. Such lines may include, for example, a fill line, an emergency vent line, and a pressure building circuit. The two lines shown are the delivery line assembly 130 and the economizer circuit assembly 114. The delivery line assembly 130 and the economizer circuit assembly 114 are coupled, and in fluid communication, at the integration device 150 (described below).

The delivery line assembly 130 includes a delivery line 132 that extends from a use device 101, such as, but not limited to, an engine, to a point within the liquid space 122, preferably near the bottom of the storage space 120. The delivery line assembly 130 may further include a vaporizer 134. The delivery line assembly 130 is structured to draw the cryogenic liquid from the liquid space 122 and deliver the cryogenic liquid, or a gas evaporated therefrom, to the use device 101. That is, while cryogenic liquid is withdrawn from the liquid space 122, the cryogenic liquid may be converted to gas within the delivery line 132. Alternatively, the cryogenic liquid may be delivered to the vaporizer 134. The vaporizer 134 converts the cryogenic liquid to a gas which is then delivered to the use device 101. The delivery line 132 includes a vertical portion 136 that extends in a generally vertical direction. The delivery line assembly 130 includes one or more valves 102, structured to open and close the delivery line 132.

The economizer circuit assembly 114 includes a vent line 140 and an integration device 150. The integration device 150 is, preferably disposed at a location outside of the first, outer vessel shell 116. The vent line has a first end 142 and a second end 144. The vent line first end 142 extends into the cryogenic vessel vapor space 124. The vent line second end 144 is coupled to the integration device 150.

The integration device 150 is a venturi assembly 152 disposed on the delivery line 132. The venturi assembly 152 includes an hourglass shaped conduit 154 that has a minimal diameter that is smaller than the diameter of the delivery line 132. There is a generally smooth transition section 155 between the delivery line 132 and the conduit 154. The flow path for the cryogenic liquid is through the conduit 154. The venturi assembly 152 also includes a venturi opening 156 that extends from outside the venturi assembly 152 to a point within the conduit 154. The vent line second end 144 is coupled to, and in fluid communication with, the venturi opening 156. The integration device 150 is, preferably, located at, or near, the bottom of the delivery line vertical portion 136.

The economizer circuit assembly 114 may further include a back pressure regulator 146. The back pressure regulator 146 is structured to close the vent line 140 when the pressure on the cryogenic liquid vessel assembly 110 side drops below a set limit. As is known in the art, both the delivery line assembly 130 and the economizer circuit assembly 114 may include valves structured to open and close the individual lines, as well as additional safety devices, such as burst disks.

In operation, the vapor space 124 holds a quantity of gas that has evaporated from the cryogenic liquid. The gas pressurizes the storage space 120. When the delivery line assembly valve 102 is opened, cryogenic liquid flows through the delivery line 132 to the use device 101. Additionally, gas from the vapor space 124 flows through the economizer circuit assembly 114 to the integration device 150. As the cryogenic liquid passes through the integration device 150, the speed of the cryogenic liquid increases due to the smaller diameter of the conduit 154. The increase in the speed of the flow creates a low pressure zone within the conduit 154. Because the venturi opening 156 is in fluid communication with both the conduit 154 and the vent line 140, the low pressure zone draws gas through the venturi opening 156 and into the cryogenic liquid flow. The gas forms bubbles in the liquid flow and are carried away. Thus, gas within the vapor space 124 is pulled from the cryogenic vessel storage space 120, thereby reducing the pressure within the cryogenic vessel storage space 120. If the pressure within the cryogenic vessel storage space 120 drops below a set limit, the back pressure regulator 146 closes the vent line 140, thereby allowing the pressure to build within the cryogenic vessel storage space 120.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An economizer circuit assembly for a cryogenic liquid vessel assembly, said cryogenic vessel assembly including a first, outer shell and a second, inner shell defining a storage space, said storage space having a liquid in a liquid space and a vapor in a vapor space, said vapor and said liquid being at, or about, the same saturation pressure, said cryogenic vessel having a delivery line extending from outside said first, outer vessel shell into said liquid space, said delivery line structured to draw liquid from said liquid space and pass a flow of said liquid through said delivery line, said economizer circuit assembly comprising:

a vent line extending from outside said first, outer vessel shell into said cryogenic vessel and having a first end and a second end, said first end disposed in said vapor space;

an integration device structured to integrate gas bubbles into a flow of liquid;

said vent line and said delivery line coupled, and in fluid communication at, said integration device; and;

whereby gas from said vapor space is integrated into said liquid flow in the form of bubbles.

2. The economizer circuit assembly for a cryogenic liquid vessel assembly of claim 1, wherein said vent line extending from outside said cryogenic vessel into said cryogenic vessel and having a first end and a second end, said second end extending within said delivery line.

3. The economizer circuit assembly for a cryogenic liquid vessel assembly of claim 2, wherein said vent line second end extends in a generally vertical direction within said delivery line.

4. The economizer circuit assembly for a cryogenic liquid vessel assembly of claim 3, wherein said integration device includes a plurality of perforations disposed at said second end.

5. The economizer circuit assembly for a cryogenic liquid vessel assembly of claim 4, wherein said vent line includes a back pressure regulator.

6. The economizer circuit assembly for a cryogenic liquid vessel assembly of claim 5, wherein said integration device is disposed outside of said first, outer vessel shell.

7. The economizer circuit assembly for a cryogenic liquid vessel assembly of claim 1, wherein said integration device is a venturi assembly.

8. The economizer circuit assembly for a cryogenic liquid vessel assembly of claim 7, wherein:

said delivery line has a diameter;

said venturi assembly is disposed on said delivery line;

said venturi assembly having a conduit with a diameter that is smaller than the delivery line diameter; and said vent line coupled to said venturi assembly at said conduit with a diameter that is smaller than the delivery line diameter.

9. The economizer circuit assembly for a cryogenic liquid vessel assembly of claim 8, wherein:

said venturi assembly includes a venturi opening; and said vent line is coupled to, and in fluid communication with, said venturi opening.

10. The economizer circuit assembly for a cryogenic liquid vessel assembly of claim 9, wherein said vent line includes a back pressure regulator.

11. A cryogenic vessel comprising:

a first, outer vessel shell; a second, inner vessel shell defining a storage space, said storage space having a liquid in a liquid space and a vapor space, said vapor and said liquid being at, or about, the same saturation pressure, said second, inner vessel shell disposed within said first, outer vessel shell;

a delivery line extending from outside said first, outer vessel shell into said liquid space, said delivery line structured to draw liquid from said liquid space and pass a flow of said liquid through said delivery line;

an economizer circuit assembly comprising:

a vent line extending from outside said first, outer vessel shell into said cryogenic vessel and having a first end and a second end, said first end disposed in said vapor space;

an integration device structured to integrate gas bubbles into a flow of liquid;

said vent line and said delivery line coupled, and in fluid communication at, said integration; and whereby gas from said vapor space is integrated into said liquid flow in the form of bubbles.

12. The economizer circuit assembly for a cryogenic liquid vessel assembly of claim 11, wherein said vent line extending from outside said cryogenic vessel into said cryogenic vessel and having a first end and a second end, said second end extending within said delivery line.

13. The economizer circuit assembly for a cryogenic liquid vessel assembly of claim 12, wherein said vent line second end extends in a generally vertical direction within said delivery line.

14. The economizer circuit assembly for a cryogenic liquid vessel assembly of claim 13, wherein said integration device includes a plurality of perforations disposed at said second end.

15. The economizer circuit assembly for a cryogenic liquid vessel assembly of claim 14, wherein said vent line includes a back pressure regulator.

16. The economizer circuit assembly for a cryogenic liquid vessel assembly of claim 15, wherein said integration device is disposed outside of said first, outer vessel shell.

17. The economizer circuit assembly for a cryogenic liquid vessel assembly of claim 11, wherein said integration device is a venturi assembly.

18. The economizer circuit assembly for a cryogenic liquid vessel assembly of claim 17, wherein:

said delivery line has a diameter;

said venturi assembly is disposed on said delivery line;

said venturi assembly having a conduit with a diameter that is smaller than the delivery line diameter; and said vent line coupled to said venturi assembly at said conduit with a diameter that is smaller than the delivery line diameter.

19. The economizer circuit assembly for a cryogenic liquid vessel assembly of claim 18, wherein:

said venturi assembly includes a venturi opening; and said vent line is coupled to, and in fluid communication with, said venturi opening.

20. The economizer circuit assembly for a cryogenic liquid vessel assembly of claim 19, wherein said vent line includes a back pressure regulator.

* * * * *

UNITED STATES PATENT AND TRADEMARK OFFICE

CERTIFICATE OF CORRECTION

PATENT NO. : 7,073,339 B2
APPLICATION NO. : 10/754756
DATED : July 11, 2006
INVENTOR(S) : Ivan Keith Hall and Justin Charles Gish It is certified that error appears in the above-identified patent and that said Letters Patent is hereby corrected as shown below:

Column 7, line 24, insert the word --device-- after the word "integration".

Signed and Sealed this

Seventh Day of November, 2006

JON W. DUDAS
*Director of the United States Patent and Trademark Office*